US006302198B1

(12) United States Patent
Ritorto et al.

(10) Patent No.: US 6,302,198 B1
(45) Date of Patent: Oct. 16, 2001

(54) ONE TRIP MILLING SYSTEM

(76) Inventors: Leonardo Ritorto, 9806-85 Avenue, Edmonton, Alberta (CA), T6E 2J6; Dave L. Heinley, 50157 Range Road 225, Sherwood Park, Alberta (CA), T8C 1H1

( * ) Notice: Subject to any disclaimer, the term of this patent is extended or adjusted under 35 U.S.C. 154(b) by 0 days.

(21) Appl. No.: 09/450,835

(22) Filed: Nov. 29, 1999

(51) Int. Cl.[7] ..... E21B 7/08; E21B 29/06

(52) U.S. Cl. ..... 166/55.1; 166/117.5; 175/80; 175/82; 175/385

(58) Field of Search ..... 166/55, 55.1, 117.5, 166/117.6, 298; 175/79, 80, 81, 82, 385

(56) References Cited

U.S. PATENT DOCUMENTS

| | | | |
|---|---|---|---|
| 2,020,471 | 11/1935 | Layne | 255/1 |
| 2,105,722 | 1/1938 | Barrett et al. | 255/1 |

(List continued on next page.)

FOREIGN PATENT DOCUMENTS

| | | |
|---|---|---|
| 2033048 | 12/1990 | (CA) . |
| 2051724 | 9/1991 | (CA) . |
| 2142994 | 9/1993 | (CA) . |
| 2125772 | 10/1993 | (CA) . |
| 2181562 | 7/1994 | (CA) . |
| 2164442 | 9/1994 | (CA) . |
| 2151215 | 6/1995 | (CA) . |
| 2164773 | 12/1995 | (CA) . |
| 2195522 | 5/1996 | (CA) . |
| 2225207 | 7/1996 | (CA) . |
| 2182535 | 8/1996 | (CA) . |
| 2234689 | 10/1996 | (CA) . |
| 2242341 | 1/1997 | (CA) . |
| 2200937 | 3/1997 | (CA) . |
| 2200938 | 3/1997 | (CA) . |
| 2262106 | 7/1997 | (CA) . |
| 2238628 | 9/1997 | (CA) . |
| 221435 | 11/1997 | (CA) . |
| 2242026 | 6/1998 | (CA) . |
| 3942438C2 | 1/1992 | (DE) . |
| 0434924B1 | 9/1993 | (EP) . |
| WO9804804A | 2/1998 | (WO) . |
| WO9822689A | 5/1998 | (WO) . |

OTHER PUBLICATIONS

Trackmaster the Real One Brochure, Smith International inc., USA, 1996.

Photocopy of International Search Report on corresponding PCT patent application PCT/CA00/01243, dated Feb. 27, 2001, 4 pages.

*Primary Examiner*—George Suchfield
(74) *Attorney, Agent, or Firm*—Joseph W. Holland

(57) ABSTRACT

A one trip whipstock system includes both a one trip combination mill and associated whipstock. The one trip combination mill comprises an upper cutter and lower cutter below the upper cutter. The upper cutter and lower cutter are joined by a cone that widens towards the upper cutter. In operation, a whipstock is connected to the drilling sub by shear bolts. A guide lug on the whipstock faces the drilling sub between the lower cutter and upper cutter for riding on the cone when the drilling sub is advanced along the whipstock. Preferably the shear bolts connect to the lower cutter. Also, the lower cutter has smaller gauge than the upper cutter, to such an extent that the relative gauge sizes of the lower cutter and upper cutter permit the upper cutter to exit casing during drilling before the lower cutter exits casing. Further, there may be provided a watermelon mill and a string mill above the upper cutter and the watermelon mill, string mill and the upper cutter preferably have the same gauge. To reduce outer diameter wear on the upper cutter, it has a square leading edge.

13 Claims, 3 Drawing Sheets

U.S. PATENT DOCUMENTS

| | | | | |
|---|---|---|---|---|
| 2,216,936 | | 10/1940 | Sinclair | 255/1 |
| 2,227,233 | * | 12/1940 | Scott et al. | 175/80 |
| 2,509,144 | | 5/1950 | Grable et al. | 255/1.6 |
| 2,667,332 | | 1/1954 | McCune et al. | 255/1.6 |
| 2,882,015 | | 4/1959 | Beck | 255/1.6 |
| 3,115,935 | | 12/1963 | Hooton | 166/117.6 |
| 3,116,799 | | 1/1964 | Lemons | 175/61 |
| 3,397,746 | | 8/1968 | Link | 166/117.6 |
| 3,554,304 | * | 1/1971 | Link et al. | 175/259 |
| 3,908,759 | | 9/1975 | Cagle et al. | 166/117.6 |
| 4,031,974 | | 6/1977 | Peterson | 175/334 |
| 4,182,423 | | 1/1980 | Ziebarth et al. | 175/61 |
| 4,266,621 | | 5/1981 | Brock | 175/329 |
| 4,285,399 | | 8/1981 | Holland et al. | 166/113 |
| 4,304,299 | | 12/1981 | Holland et al. | 166/255 |
| 4,397,355 | | 8/1983 | McLamore | 166/297 |
| 4,765,404 | | 8/1988 | Bailey et al. | 166/117.6 |
| 5,109,924 | | 5/1992 | Jurgens et al. | 166/117.5 |
| 5,425,419 | | 6/1995 | Sieber | 166/206 |
| 5,474,126 | * | 12/1995 | Lynde et al. | 166/117.6 |
| 5,592,991 | | 1/1997 | Lembecke | 166/298 |
| 5,641,027 | * | 6/1997 | Foster | 175/385 X |
| 5,657,820 | * | 8/1997 | Bailey et al. | 166/117.6 X |
| 5,676,206 | | 10/1997 | Rehbock et al. | 166/117.5 |
| 5,727,629 | * | 3/1998 | Blizzard, Jr. et al. | 175/80 X |
| 5,769,166 | | 6/1998 | Duke | 166/298 |
| 5,769,167 | | 6/1998 | Braddick | 166/382 |
| 5,771,972 | | 6/1998 | Dewey et al. | 166/298 |
| 5,816,324 | | 10/1998 | Sweartingen et al. | 166/117 |
| 5,826,651 | * | 10/1998 | Lee et al. | 175/80 X |
| 5,887,668 | | 3/1999 | Haugen et al. | 175/79 |
| 6,102,123 | * | 8/2000 | Bailey et al. | 166/117.6 X |

* cited by examiner

ONE TRIP MILLING SYSTEM

FIELD OF THE INVENTION

This invention relates to downhole drilling systems in which whipstocks are used to deviate a well.

BACKGROUND OF THE INVENTION

A variety of one trip milling systems are known, such as shown in U.S. Pat. No. 5,109,924, issued May 5, 1992. Other examples of one trip milling systems are shown in Canadian patent applications 2,242,026 (published Jun. 30, 1998) 2,221,435 (Nov. 18, 1997); 2,225,201 (Jul. 8, 1996); 2,182,535 (Aug. 1, 1996); 2,200,937 (Mar. 25, 1997); 2,033,048 (Dec. 21, 1990); and U.S. Pat. No. 5,771,972 (Jun. 30, 1998). In general these one trip milling systems include an initial or pilot mill, followed by a second mill on the drill string, and are used in association with a whipstock that is anchored in the well by a variety of means. The pilot mill rides on the whipstock and is deflected outward into contact with casing in the well to mill an initial window. A following mill then mills the edges of the window and drilling then follows the path established by the following mill through the casing.

SUMMARY OF THE INVENTION

In a one trip milling system, the object is to avoid having to make more than one trip to complete the deviation of the well. One problem is that as the mill advances through the casing, it can become worn, with the result that the diameter of the deviated wellbore becomes smaller, thus making tight spots in the well that can impede drilling. It is an object of the present invention to provide an improved one trip milling system that maintains the mill in fill gauge throughout the milling procedure.

There is thus provided in accordance with an embodiment of the invention, a one trip whipstock system which includes both a one trip combination mill and associated whipstock. The one trip mill comprises an upper cutter and lower cutter below the upper cutter. The upper cutter and lower cutter are joined by a cone that widens towards the upper cutter. In operation, a whipstock is connected to the drilling sub by shear bolts. A guide lug on the whipstock faces the drilling sub between the lower cutter and upper cutter for riding on the cone when the drilling sub is advanced along the whipstock. Preferably the shear bolts connect to the lower cutter. Also, the lower cutter has smaller gauge than the upper cutter, to such an extent that the relative gauge sizes of the lower cutter and upper cutter permit the upper cutter to exit casing during drilling before the lower cutter exits casing. Further, there may be provided a watermelon mill above the upper cutter, and optionally but preferably a string mill above the watermelon mill and the watermelon mill, string mill and the upper cutter preferably have the same gauge. To reduce outer diameter wear on the upper cutter, and thus maintain the gauge of the cutter during drilling, the upper cutter has a square leading edge.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope or the invention, in which like numerals denote like elements and in which.

DETAILED DESCRIPTION OF PREFERRED EMBODIMENTS

In this patent document, "comprising" means "including". In addition, a reference to an element by the indefinite article "a" does not exclude the possibility that more than one of the element is present. The terms upper and lower or above and below refer to the conventional uphole and downhole directions during drilling.

Figure 1:
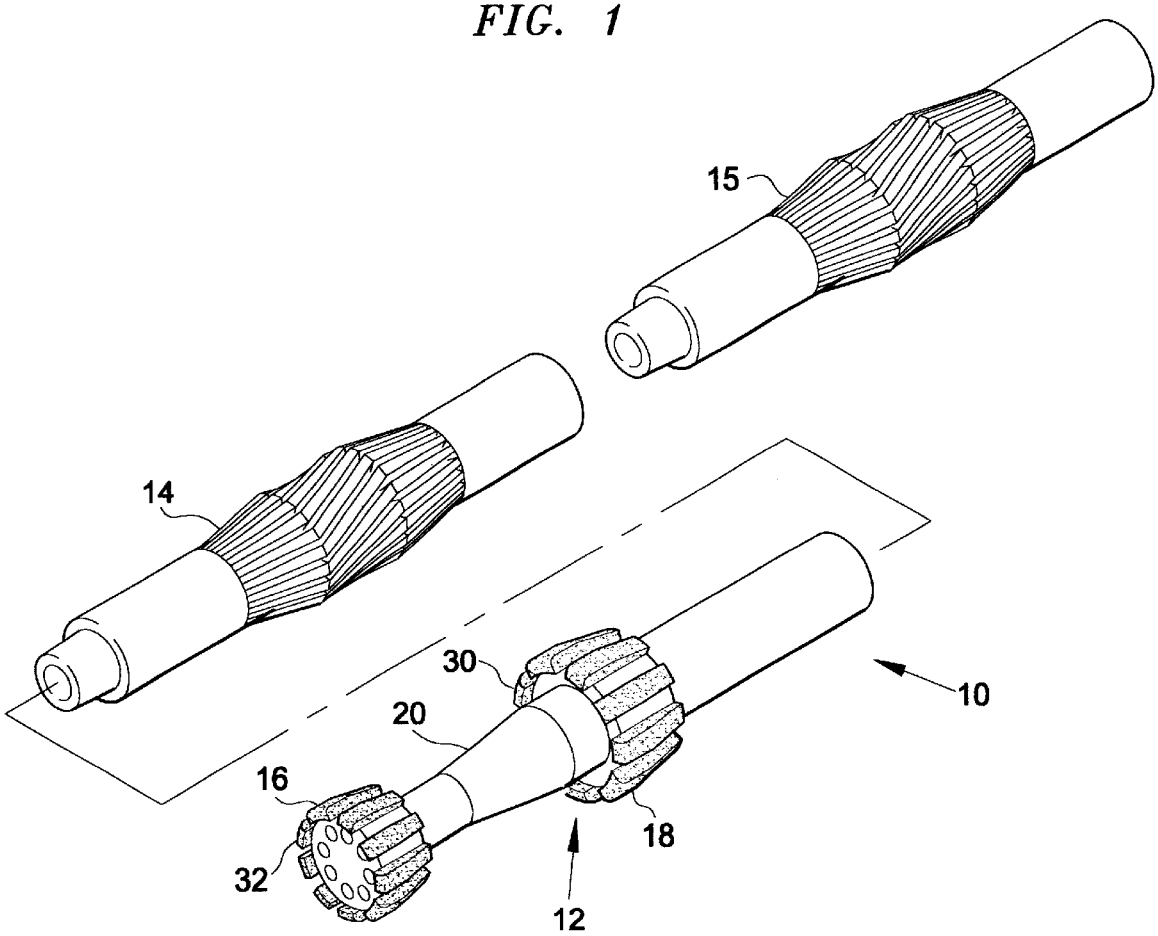
FIG. 1 shows a one trip combination mill according to the invention, with watermelon mill and string mill.

An exemplary one trip whipstock system as shown in FIG. 1 incorporates a drilling sub 10, which includes both a one trip combination mill 12, a watermelon mill 14 above the one trip combination mill 12 and a string mill 15 above the watermelon mill 14. The one trip combination mill 12 has a lower cutter 16 and above that an upper cutter 18 joined by a cone 20 that widens towards the upper cutter 18. The watermelon mill 14 preferably has the same gauge as the upper cutter 18, and likewise the string mill 15. The watermelon mill 14 differs from the string mill 15 by the string mill 15 having a more aggressive action caused by a steeper face on the cutting surface, for example a 15° slope on the string mill 15 compared with a 7° slope on the watermelon mill 14. The watermelon mill 14 and the string mill 15 may be interchanged in position. The function of the watermelon mill 14 and string mill 15 is to round off and smoothen the rough edges of the window created by the one trip combination mill and assist in avoiding tight spots in the deviated well bore.

Figure 2:
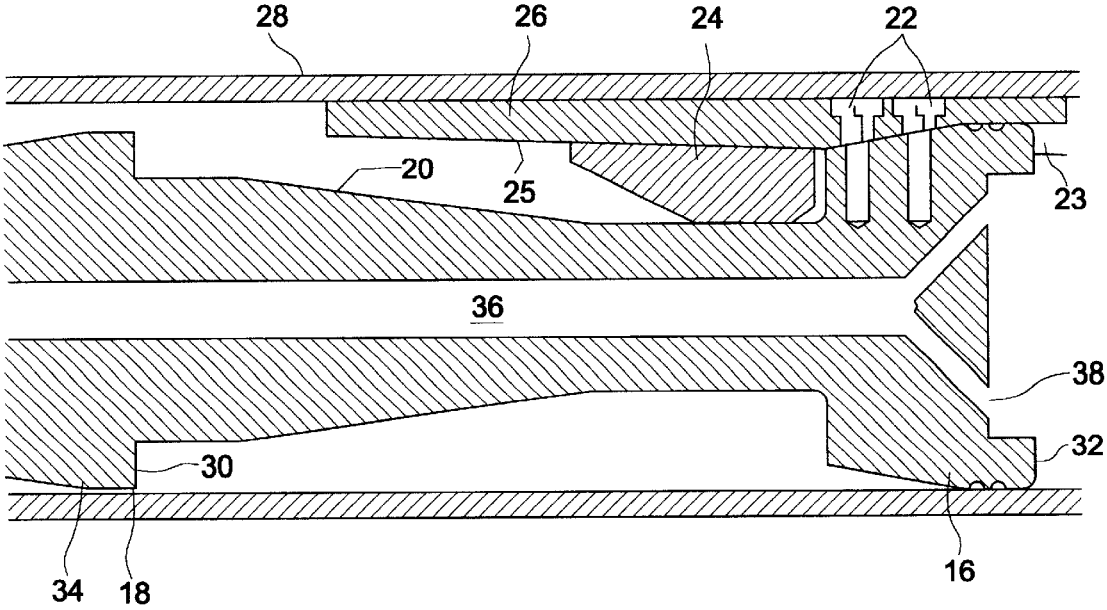
FIG. 2 shows a one trip combination mill according to the invention installed on a whipstock.
Figure 3:
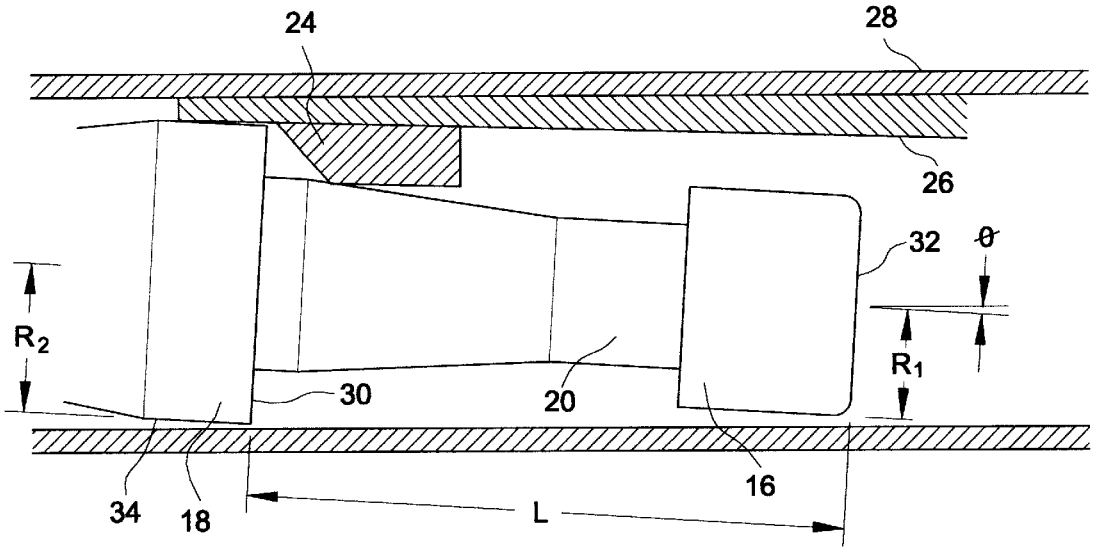
FIG. 3 shows a one trip combination mill according to the invention just after commencement of the milling procedure.

The drilling sub 10 is used in association with a whipstock 26 as shown in FIGS. 2 and 3. The whipstock 26 is for the most part conventional, and is set in a well in conventional manner. The drilling sub 10 is connected to the whipstock 26 by shear bolts 22 with the lower cutter 16 resting in a pocket 23 in the concave face 25 of the whipstock 26. The shear bolts 22 are in themselves conventional and it is known to use shear bolts in association with one trip milling systems. In this particular design, the shear bolts 22 are threaded into the lower cutter 16. A guide lug 24 is provided on the whipstock 26 uphole of the shear bolts 22. The guide lug 24 may be welded to the whipstock, and is located in a position such that the guide lug 24 faces the drilling sub 10 between the upper cutter 18 and the lower cutter 16 on the one trip mill 12. In this position, the guide lug 24 rides on the cone 20 (or, equivalently, the cone 20 rides on the guide lug 24) when the drilling sub 10 is advanced along the whipstock 26.

The lower cutter 16 has smaller gauge (R1) than the gauge (R2) of the upper cutter 18, as for example 3.375" compared with 4.75". The relative gauge sizes of the lower cutter 16 and upper cutter 18 are chosen so that the upper cutter 18 exits the casing 28 during drilling before the lower cutter 16 exits the casing 28. For this purpose, it is preferred that the drill string be relatively stiff so that the effective pivot for the drilling sub 10 is high in the hole. This causes the upper cutter 18 to move outward nearly the same amount as the lower cutter 16 when the cone 20 rides on the guide lug 24. As a consequence, due to the enlarged upper cutter 18, it exits the casing first, although the lower cutter 16 makes a smaller opening in advance of the upper cutter 18. The principle of operation of the relative gauge sizes is illustrated in FIG. 3. L is the distance between the square forward cutting edges of the upper cutter 18 and lower cutter 16. θ is the angle between the central axis of the drilling sub 10 and the downhole direction, that is, it is the slant angle of the drilling sub 10 in the hole as it is deflected by the guide lug 24. The slant angle depends on the stiffness of the drill string. For any given drill string, to ensure that the upper cutter 18 exits the casing first, the equation $(R2-R1)L>\sin\theta$ should be satisfied.

As the upper cutter 18 advances along the whipstock 26, it grinds off the guide lug 24, and thus the material of the guide lug 24 should be easily millable. The cutters 18 and 16 should have square leading edges as shown, so that the faces 30 and 32 carry out the milling of the casing, thus avoiding wear on the outer diameter 34 of the upper cutter 18. By square in this context is meant that the leading faces 30 and 32 of the cutters 16 and 18 are essentially perpendicular to the tool axis, different from the watermelon mill 14. In this manner, the gauge R2 of upper cutter 18 defines the deviated borehole diameter, and the deviated borehole diameter is maintained reasonably constant. It is preferred that cutters 16 and 18 be used with conventional blades as shown forming the square cutting edges of the cutters. The blades o the cutters 16 and 18 are such as are used on mills by Black Max Downhole Tools Inc. of Edmonton, Alberta, Canada, and are machined from the metal of the drilling sub. Each individual blade is coated in known fashion in the art of drill bits with crushed carbide to provide the cutting surface on the cutters 18 and 16.

A fluid passage 36 passes through the entire one trip combination mill 12, string mill 15 and watermelon mill 14 and exits the forward end of the lower cutter 16 through holes 38, of which there can be any number, for example eight. This allows for lubrication and cleaning of the bore as drilling progresses.

To commence drilling, the whipstock is placed downhole in conventional manner. A load is then placed on the whipstock to set slips and hold the whipstock in place. Next, a higher load is placed on the string (of which the drilling sub 10 is a part) to shear the bolts 22 and allow the string to rotate. The drill string is rotated and advanced slowly. When the drill string advances, the cone 20 rides over the guide lug 24 and forces the cutters 16, 18 to cut into the casing. Once the one trip combination mill 12 has advanced and the cone 20 has slid on the guide lug 24 to the largest diameter of the cone 20, the upper cutter 18 grinds the guide lug 24 off and proceeds to cut the casing as it slides along the concave of the whipstock. The one trip combination mill 12 eventually leaves the casing completely, continues cutting through the formation 40 and completes the sidetracking manouevre. The one trip combination mill 12 is then removed from the well bore.

Immaterial modifications may be made to the invention described here without departing from the essence of the invention.

The embodiments of the invention in which an exclusive property or privilege is claimed are define as follows:

1. A one trip combination mill, comprising:

a drilling sub having an upper cutter and lower cutter below the upper cutter;

the lower cutter having smaller gauge than the upper cutter;

the relative gauge sizes of the upper cutter and lower cutter permitting the upper cutter to exit casing during drilling before the lower cutter exits casing; and the upper cutter and lower cutter being connected by a cone that widens towards the upper cutter.

2. The one trip combination mill of claim 1 further comprising a watermelon mill above the upper cutter, and the upper cutter and the watermelon mill have the same gauge.

3. The one trip combination mill of claim 2 further comprising a string mill above the upper cutter, and the string mill and the upper cutter have the same gauge, the string mill having a more aggressive cutting action than the watermelon mill.

4. A one trip combination mill, comprising:

a drilling sub having an upper cutter and lower cutter below the upper cutter;

the upper cutter and lower cutter being connected by a cone that widens towards the upper cutter; and the upper cutter having a square leading edge for cutting through casing.

5. The one trip combination mill of claim 4 in which the lower cutter has a square leading edge for cutting through casing.

6. A one trip whipstock system, comprising:

a drilling sub having an upper cutter and lower cutter below the upper cutter;

the upper cutter and lower cutter being connected by a cone that widens towards the upper cutter;

the upper cutter having a square leading edge;

a whipstock connected to the drilling sub by shear bolts; and a guide lug on the whipstock, the guide lug facing the drilling sub between the upper cutter and the lower cutter for riding on the cone when the drilling sub is advanced along the whipstock.

7. The one trip milling system of claim 6 in which the shear bolts connect to the lower cutter.

8. The one trip milling system of claim 6 in which the lower cutter has smaller gauge than the upper cutter.

9. The one trip milling system of claim 8 in which the relative gauge sizes of the lower cutter and upper cutter permit the upper cutter to exit casing during drilling before the lower cutter exits casing.

10. The one trip milling system of claim 6 further comprising a watermelon mill above the upper cutter.

11. The one trip milling system of claim 10 in which the upper cutter and the watermelon mill have the same gauge.

12. The one trip milling system of claim 11 further comprising a string mill above the upper cutter and the string mill has a more aggressive milling action than the watermelon mill.

13. The one trip milling system of claim 12 in which the string mill and the upper cutter have the same gauge.

* * * * *

UNITED STATES PATENT AND TRADEMARK OFFICE

CERTIFICATE OF CORRECTION

PATENT NO. : 6,302,198 B1
DATED : October 16, 2001
INVENTOR(S) : Ritorto et al.

It is certified that error appears in the above-identified patent and that said Letters Patent is hereby corrected as shown below:

Title page,
After Item [76], insert:
-- [73] Assignee: CANADIAN DOWNHOLE DRILL SYSTEMS, INC.
Nisku, Alberta CANADA --

Signed and Sealed this

Seventeenth Day of December, 2002

JAMES E. ROGAN
*Director of the United States Patent and Trademark Office*